US005575472A

United States Patent [19]

Magerman et al.

[11] Patent Number: 5,575,472

[45] Date of Patent: Nov. 19, 1996

[54] GOLF PUTTER HEAD HAVING FACE INSERT AND METHOD OF FORMING THE SAME

[75] Inventors: Michael L. Magerman; Bradley V. Adams, both of Carlsbad; Brian R. Pond, San Marcos, all of Calif.

[73] Assignee: Odyssey Sports, Inc., Carlsbad, Calif.

[21] Appl. No.: 282,202

[22] Filed: Jul. 27, 1994

[51] Int. Cl.[6] ..... A63B 53/04

[52] U.S. Cl. ..... 29/530; 473/342

[58] Field of Search ..... 273/173, 78, 167 J, 273/167 H; 29/530, 557

[56] References Cited

U.S. PATENT DOCUMENTS

| | | | |
|---|---|---|---|
| 3,817,522 | 6/1974 | Simmons | 273/78 |
| 3,847,399 | 11/1974 | Raymont | 273/78 |
| 4,679,792 | 7/1987 | Straza et al. | 273/78 |
| 4,991,843 | 12/1991 | Mori | 273/80.3 |
| 5,078,397 | 7/1992 | Aizawa | 273/78 |
| 5,198,062 | 3/1993 | Chen | 273/173 |
| 5,261,663 | 11/1993 | Anderson | 273/173 |
| 5,301,941 | 4/1994 | Allen | 273/78 |

FOREIGN PATENT DOCUMENTS

| | | | |
|---|---|---|---|
| 1016895 | 10/1962 | United Kingdom | 273/173 |

*Primary Examiner*—V. Milliw
*Assistant Examiner*—Charles W. Anderson
*Attorney, Agent, or Firm*—Barry N. Young; Marnie Wright Barnhorst; Gray Cary Ware & Freidenrich

[57] ABSTRACT

A golf putting head is formed to include a recess cavity on its front face which preferably includes a raised perimeter bead. The insert is cast in place within the cavity with the perimeter bead allowing the insert to extend slightly beyond the club face. Once cured within the cavity, the insert perimeter bead and club face is finished to remove the perimeter bead and provide a smooth planar surface for the insert and the club face.

5 Claims, 2 Drawing Sheets

FIG. 2A
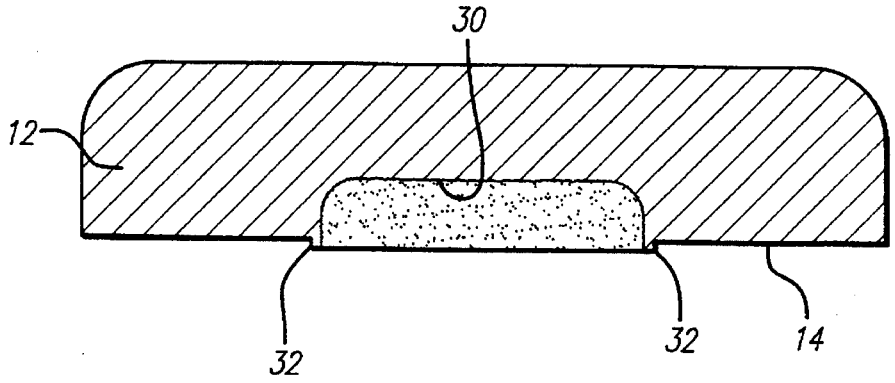
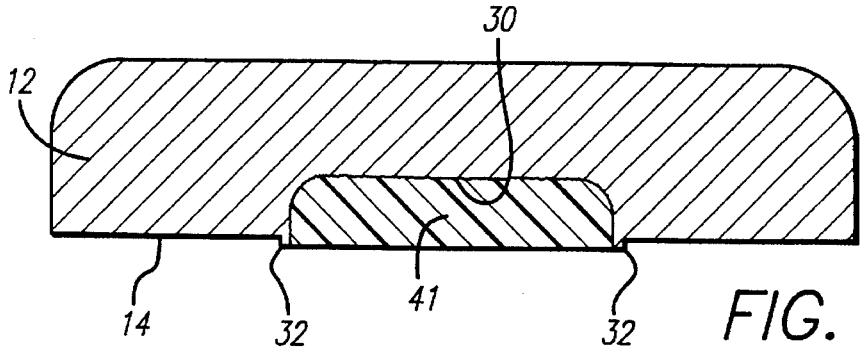
FIG. 2B
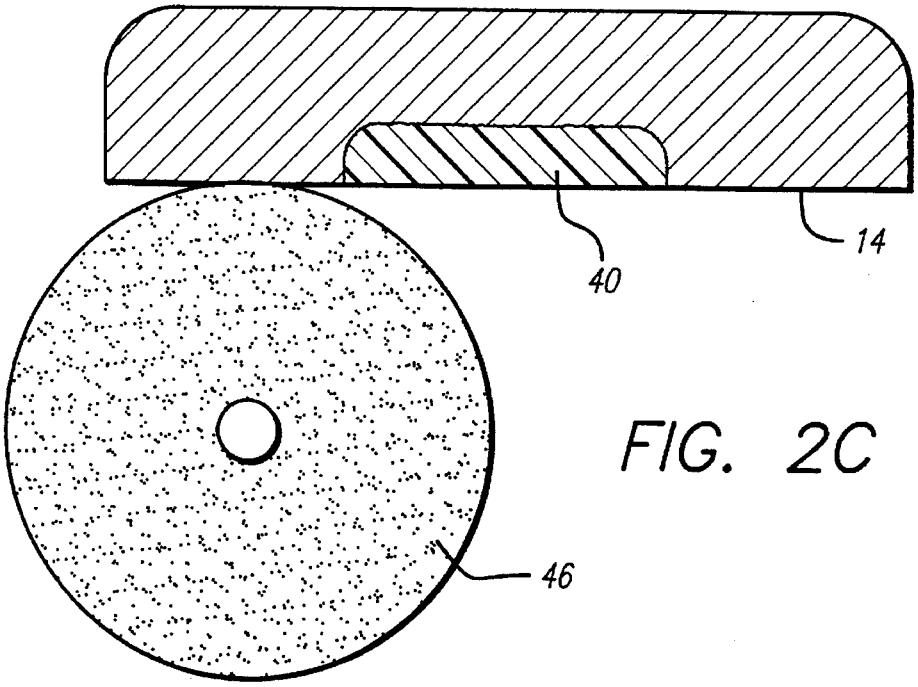
FIG. 2C

GOLF PUTTER HEAD HAVING FACE INSERT AND METHOD OF FORMING THE SAME

FIELD OF THE INVENTION

The present invention relates generally to golf putters and more particularly to an improved golf putter head having a face insert and a method of forming the same.

BACKGROUND OF THE INVENTION

As is well known, in becoming proficient in the game of golf, it is absolutely necessary for the golfer to master the putting stroke. In this regard, once the golfer has obtained proficiency in hitting woods and irons, reduction in a golfer's gross score is achieved primarily in the reduction of putting strokes upon the course. Although putting strokes vary from golfer to golfer, all proper putting strokes entail that the golf putter be swung in a pendulum fashion with the momentum imparted to the golf ball by the club head being controlled by the amount of back swing as well as the impact velocity of the club face upon the golf ball. As such, it is customary in golf putter designs to form the putter head in a configuration to assist in initiating the desired line of back swing and follow through as well as maximize the momentum imparted to the ball upon impact.

In recognition of these primary design criteria, numerous putter head configurations have been adopted in the prior art ranging from simple blade designs, to offset putter heads, to mallet designs and I-beam constructions. Additionally, in recent years, substantial design consideration has been given to moving the center of gravity of the putter head to different locations such as by conventional perimeter waiting techniques and the like.

More recently, substantial design attention has been directed toward to providing a golf putter with a face insert in the area of the putter club face which impacts the golf ball. The purpose of such inserts is to impart greater momentum to the golf ball upon impact as well as improve the "feel" of the golf putter during use. Further, such inserts often times allow greater degrees in movement of the center of gravity of the putter head by being formed of different lighter weight materials. As such, by specific design criteria, the major weight of the putter head may be placed at different locations upon the putter head by way of insert material and configuration. An example of such prior art golf putters having an insert disposed within the club face is depicted in U.S. Pat. No. 4,679,792 issued to Straza et al. on Jul. 14, 1987 entitled Golf Putter. Although such prior art insert golf putters have proven generally effective, they posses inherent deficiencies which have detracted from the wide spread use and acceptance in the marketplace.

Foremost of such deficiencies has been the inability of the prior art insert golf putters to ensure that the insert is securely captured within the golf putter face during prolonged use. In this regard, such prior art insert golf putters have typically formed the face insert as a separate molded member which is subsequently affixed to the golf putter head via adhesive and/or mechanical fasteners. During prolonged use and upon continuously confronting the impact forces associated in the putting stroke, such adhesives and/or mechanical fasteners often loosen, thereby adversely affecting the accuracy in maintaining the line of the putting stroke. Further, the use of adhesives between the insert and the putter head often times formes a hydraulic cushion in effect which dampens the momentum imparted to the ball during the putting stroke.

As such, there exists a substantial need in the art for an improved golf putter having a face insert which is affixed to the putter head without use of adhesives and/or mechanical fasteners and which further insure secure engagement of the insert with the putter head throughout prolonged use.

SUMMARY OF THE INVENTION

The present invention specifically addresses and alleviates the above-referenced deficiencies associated in the prior art. More particularly, the present invention comprises a golf putter head having a face insert which is integrally formed (i.e., molded in place) upon the putter head so as to be securely affixed to the putter head throughout prolonged duration.

The putter head of the present invention is specifically formed to include a recess or cavity formed on its front face which preferably includes a raised perimeter bead thereabout. The recess and raised perimeter bead thereby form a cavity within which the insert may be cast in place upon the putter head. Preferably, the insert is formed of a polymeric/elastomeric resin material which is poured within the cavity and subsequently cured therein. However, alternative insert materials, such as carbon fiber/epoxy resins, are contemplated herein. Preferably, the insert is filled to a level equal to, or slightly below, the outer extremity of the raised perimeter and once cured, the front face of the putter head and insert may be finished as by way of milling, grinding, sanding, and/or polishing, to remove the raised perimeter bead and provide a desired planar club face wherein the insert and remainder of the club face are disposed in a common plane or desired configuration.

Due to the insert being formed in an integral fashion within the putter head as opposed to being subsequently attached by adhesive or mechanical fasteners, the insert is securely captured within the putter head to resist loosening during prolonged use. Additionally, in view of the insert being maintained in a contiguous orientation within the recess formed within the putter head, the putter head of the present invention does not posses any hydraulic dampening between the putter head and the insert as heretofore associated in the prior art.

In the preferred embodiment, the insert is cured within the recess at an elevated temperature. However, those skilled in the art will recognize that ambient temperature curable resins, ultra violet curable resins, or elevated or ambient curable thermo-setting polymers or thermo-plastic polymers, are contemplated herein.

BRIEF DESCRIPTION OF THE DRAWINGS

These as well as other benefits and features of the present invention will become more apparent upon reference to the drawings wherein:

FIG. 2A is a cross-sectional view taken about lines 2A—2A of FIG. 1A;

FIG. 2B is a cross-sectional view analogous to FIG. 2A depicting the insert formed within the club face; and FIG. 2C is a cross-sectional view analogous to FIG. 2B schematically depicting the finishing step of the club face of the golf putter head of the present invention.

DETAILED DESCRIPTION OF THE PREFERRED EMBODIMENT

The detailed description set forth herebelow in connection with the appended drawings, is intended as a description of the presently preferred embodiment of the invention, and is not intended to represent the only form in which the present invention may be constructed or utilized. The description sets forth the function and sequence of steps for constructing and operating the present invention in connection with the illustrated embodiment. It is to be understood, however, that the same or equivalent functions and sequences may be accomplished by different embodiments that are also encompassed within the spirit and scope of the present invention.

Figure 1A:
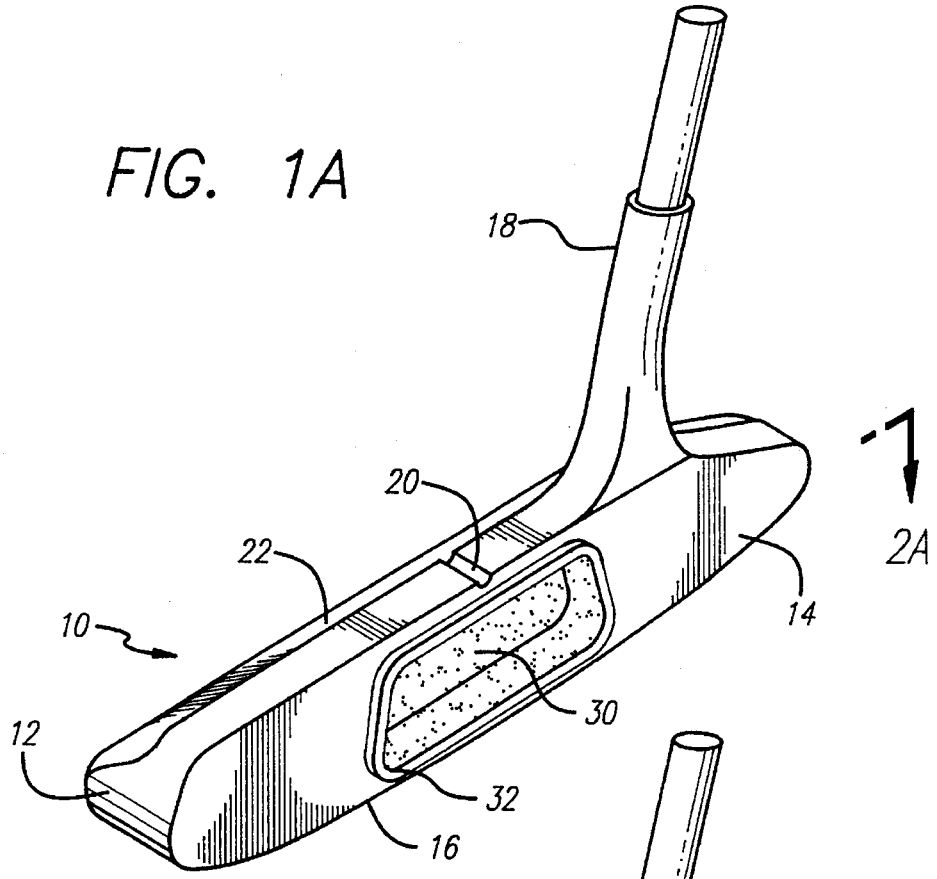
FIG. 1A is a perspective view of the improved putter head of the present invention prior to formation of its face insert.
Figure 1B:
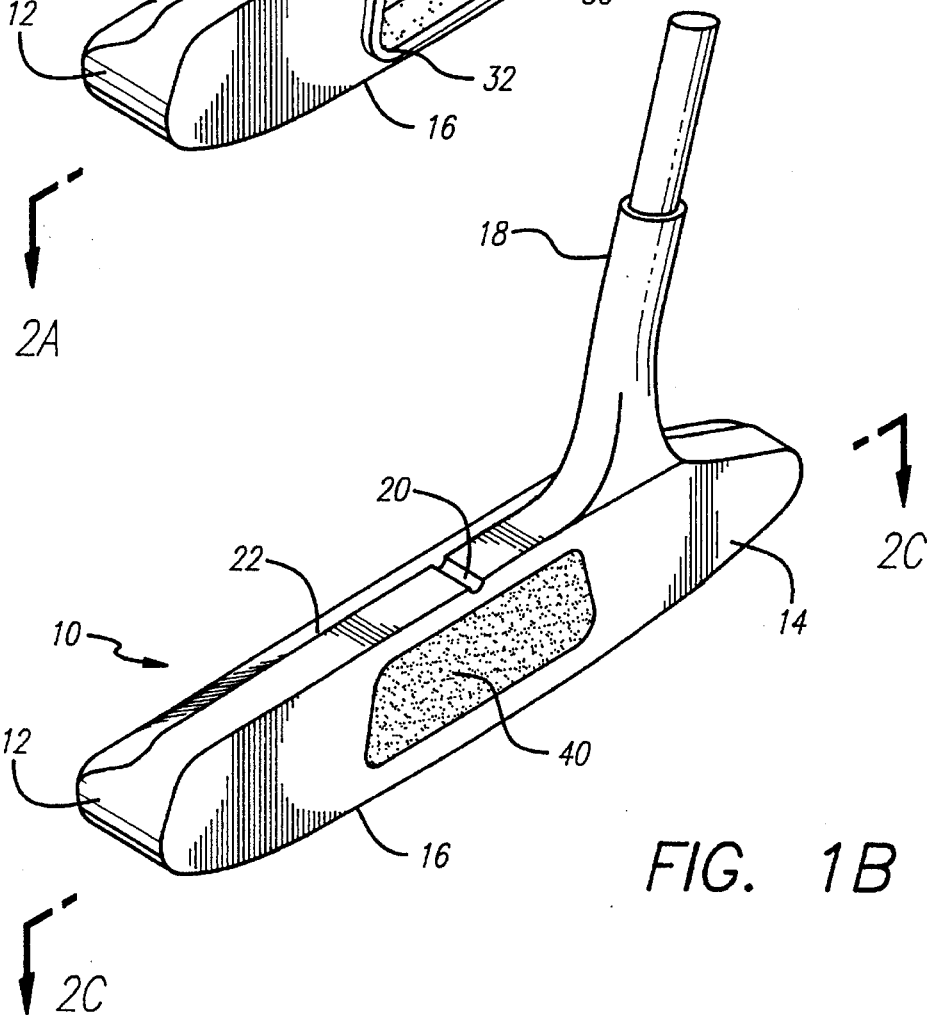
FIG. 1B is a perspective view of the improved putter head of the present invention after formation and finishing of its club face insert.

Referring generally to the Figures, FIG. 1A depicts the putter head 10 of the present invention, prior to incorporation of its face insert 40 therein, while FIG. 1B depicts the putter head 10 of the present invention after the insert 40 has been disposed and cured within the club face. As depicted in FIG. 1A and 1B, the putter head 10 is formed to have an elongate body portion 12 defining a front club face 14, sole portion 16 and upwardly extending neck portion 18. Those skilled in the art will recognize that the neck portion 18 includes a reduced diameter shank adapted to be affixed to a golf club shaft (not shown) in a conventional fashion.

The body portion 10 preferably includes an alignment recess 20 and a reduced thickness area 22 located behind the club face 14. Additionally, the sole portion 16, preferably is formed having a curvilinear configuration to reduce ground contact at the distal end of the body portion 12 during the putting stroke. Those skilled in the art will recognize that although the golf putter 10 is depicted in a presently preferred embodiment, alternative putter designs, such as a mallet, offset or blade configuration are contemplated herein.

In the preferred embodiment, the putter head 10 of the present invention is formed of a metal material such as brass, aluminum or steel, via conventional casting or forging production techniques. However, unlike the prior art in the production process, the putter head 10 is formed to include a recess 30 formed upon the club face 16 which extends rearwardly toward the rear portion 22 of the putter head 10. In the preferred embodiment, the recess 30 extends rearwardly from the club face 14 through a distance of approximately ¼ to ⅜ of an inch and is preferably formed in a trapezoidal configuration, positioned generally intermediate opposite ends of the putter face 14. However, alternative configurations and depths of the recess 30 are contemplated herein.

In the preferred embodiment, the club face 14 is additionally provided with a raised perimeter bead 32 which preferably extends a short distance outwardly from the club face 14. As will be explained in more detail infra, the raised perimeter bead 32, although not being required for implementation of the present invention, ensures that the subsequently formed insert within the cavity 30 extends a short distance beyond the club face 14 after curing, thereby enabling a more rapid finishing of the club face 14 and insert 40 after curing of the insert 40 within the recess 30.

Referring more particularly to FIGS. 2A, 2B and 2C, the particular methodology utilized in the present invention to form the insert 40 within the cavity 30 is depicted. More particularly, once the club head 10 is formed to the configuration depicted in FIG. 1A, the club head 10 is placed on a support surface such that the cavity 30 is disposed in a vertical orientation. Disposed in such a vertical orientation, a resinous or polymer material may be poured or inserted within the interior of the cavity 30 to fill the entire cavity and preferably extend to a level slightly below or equal to the outermost edge of the perimeter bead 32, as depicted in FIG. 2B. In the preferred embodiment, a polymeric or elastomeric resin is utilized as the resinous material for the insert 40 which subsequently cures (i.e., hardens). However, alternative ambient temperature resins, ultra violet curable resins, thermo-setting polymers, and/or thermo-plastic polymers are contemplated herein. Upon curing, it will be noted that the insert material 41 is molded (e.g., cast, forged, or injection molded) in place within the cavity 30 and extends outwardly approximately the distance of the outward extension of the perimeter bead 32 beyond the main club face 14 as depicted in FIG. 2B.

Once the resinous material 41 has cured within the cavity 30, the putter head 10 is finished by way of conventional milling, grinding, sanding, and/or polishing the front club face 14 as depicted in FIG. 2C. In the preferred embodiment, the front club face 14 is contacted with an end mill 46, which removes the perimeter bead 32 and that portion of the resinous material 41 extending beyond the main club face 14. Additionally, a small portion of the front club face 14 is typically removed in the finishing process to provide a smooth planar or other desired configuration to the entire length of the club face 14 and insert 40. As will be recognized, by incorporation of the raised perimeter bead 32, the amount of front club face 14 required to be removed during the finishing process is minimized, thereby reducing fabrication cost. However, those skilled in the art will recognize that the perimeter bead 32 may be eliminated from the construction of the present invention, thereby requiring additional metal removal from the club face 14 during the finishing process to ensure a smooth club face 14 and insert 40 construction.

It will additionally be recognized that the putter head 10 of the present invention contemplates the use of differing inserts 40 to in effect, modify the feel and operating characteristics of the putter head 10. In this regard, when desired, more resilient polymer materials can be utilized for the insert 40. Alternatively when desired, more hard material inserts can be utilized to enable customized performance characteristics. Further, those skilled in the art will recognize that due to the insert 40 of the present invention being integrally formed (i.e., cast or molded in place) within the putter head 10, no hydraulic cushioning of adhesive as heretofore associated in the prior art occurs in the present invention and, additionally, the insert 40 is securely retained within the putter head 10 during prolonged use.

What is claimed is:

1. A method of forming a golf putter head comprising the steps of:

forming a golf putter head from a metal material having an elongate configuration defining a generally planar front face;

forming a recess within said front face to extend rearwardly within said golf putter head, said recess defining a continuous sidewall;

forming the golf putter head to further include a continuous perimeter bead about said recess which extends outwardly beyond said front face and is substantially flush with said sidewall;

casting a curable non-metal insert within said recess; and finishing said golf putter head to remove the perimeter bead, a portion of said front face, and that portion of the insert extending beyond said front face such that the insert and the front face extend in generally co-planar relation to each other.

2. The method of claim 1 wherein said casting step comprises the step of casting a carbon/epoxy resin composite material within said recess.

3. The method of claim 1 wherein said casting step comprises the step of casting an elastomer within said recess.

4. The method of claim wherein said casting step comprises the step of casting a thermo-setting polymer within said recess.

5. The method of claim 1 wherein said casting step comprises the step of casting a thermo-plastic polymer within said recess.

* * * * *